72-264
10/15/85 CF 4,546,634

United States Patent [19]
Fuchs, Jr.

[11] Patent Number: 4,546,634
[45] Date of Patent: Oct. 15, 1985

[54] METHODS AND APPARATUS FOR INITIATING TUBULAR EXTRUSION

[76] Inventor: Francis J. Fuchs, Jr., P.O. Box 10016, Naples, Fla. 33940

[21] Appl. No.: 533,245

[22] Filed: Sep. 19, 1983

Related U.S. Application Data

[63] Continuation-in-part of Ser. No. 449,562, Dec. 13, 1982, abandoned.

[51] Int. Cl.[4] ..... B21C 25/04; B21C 31/00
[52] U.S. Cl. ..... 72/264; 72/262; 72/265; 72/253.1
[58] Field of Search ..... 72/253.1, 264, 265, 72/271, 273.5, 273, 260, 468, 467, 262

[56] References Cited

U.S. PATENT DOCUMENTS 770,997 9/1904 Beck et al. ..... 72/265
2,903,130 9/1959 Reichl ..... 72/264
2,964,177 12/1960 Scribner ..... 72/268
3,422,648 1/1969 Lemelson ..... 72/468
3,580,038 5/1971 Andreassian ..... 72/273
3,999,415 12/1976 Austen ..... 72/467

FOREIGN PATENT DOCUMENTS 406594 11/1973 U.S.S.R. ..... 72/273.5

*Primary Examiner*—Lowell A. Larson
*Attorney, Agent, or Firm*—R. Gale Rhodes, Jr.

[57] ABSTRACT

Methods and apparatus for initiating extrusion of elongated hollow product, more particularly cylindrical tubular product, by increasing the space between the end of a mandrel and an opposed extrusion die during extrusion start-up and thereafter gradually decreasing the space to the desired width for extrusion of the product to enhance extrusion initiation.

6 Claims, 8 Drawing Figures

FIG. 1
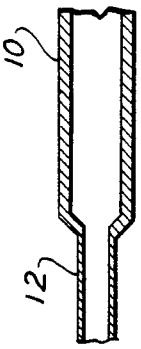
FIG. 2
FIG. 5
GRAPH OF EXTRUSION START-UP BEHAVIOR WITH AND WITHOUT RETRACTABLE PILOT
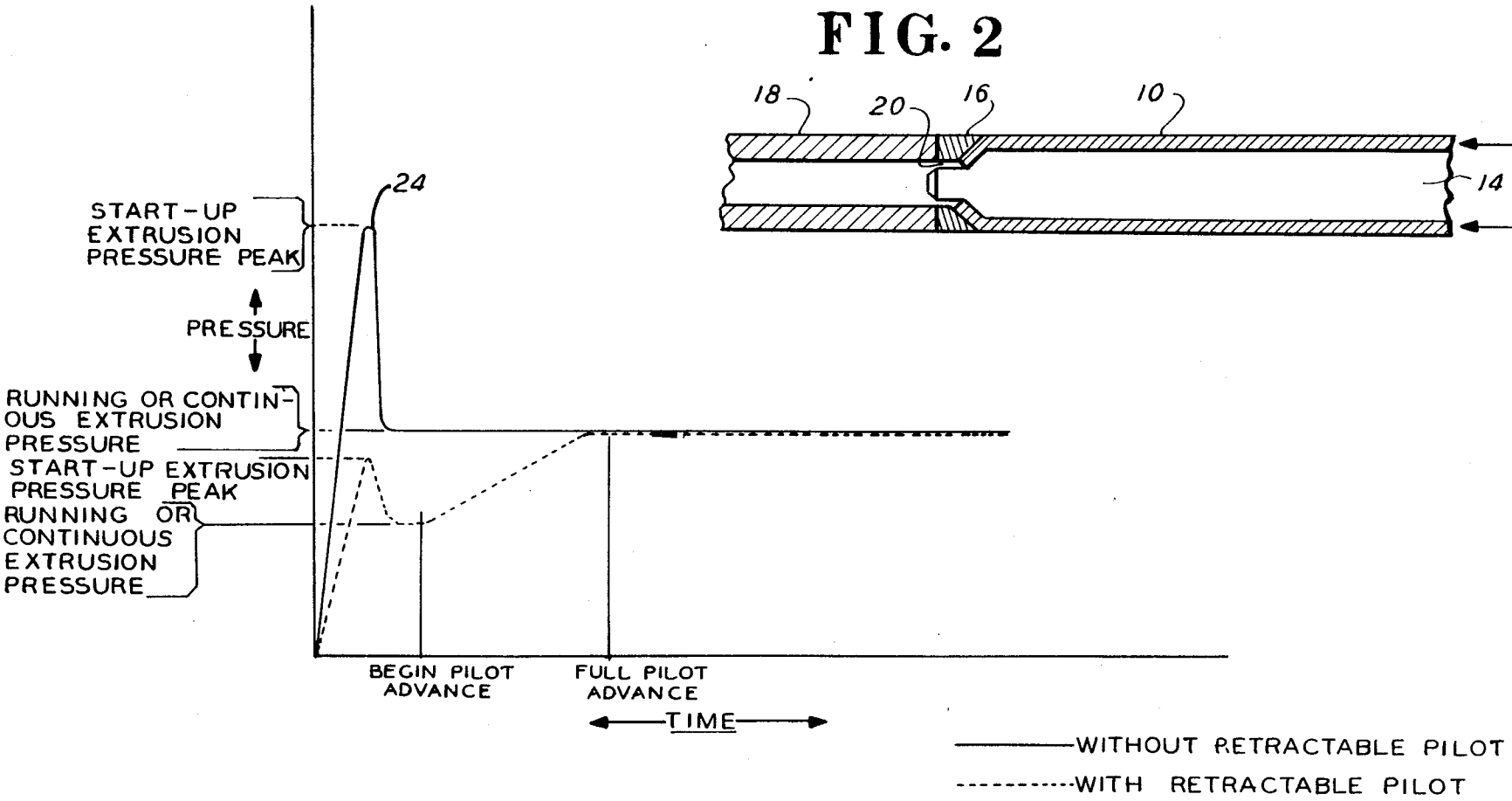

METHODS AND APPARATUS FOR INITIATING TUBULAR EXTRUSION

CROSS-REFERENCE TO RELATED APPLICATION

This application is a continuation-in-part of U.S. patent application Ser. No. 449,562, filed Dec. 13, 1982 in the name of Francis J. Fuchs, Jr. for METHODS AND APPARATUS FOR INITIATING TUBULAR EXTRUSION, now abandoned.

BACKGROUND OF THE INVENTION

This invention relates generally to improved methods and apparatus for initiating an extrusion process, and more particularly to new and improved methods and apparatus for initiating the extrusion of tubular product of decreased diameter and decreased wall thickness from a tubular workpiece of larger diameter and larger wall thickness.

As is known to those skilled in the art of extruding a tubular workpiece of larger diameter and larger wall thickness into tubular product of smaller diameter and reduced wall thickness, typically, the tubular workpiece is advanced through an annular space provided between the end of the mandrel and the opposed surface of a tapered extrusion die of decreasing diameter in the direction of extrusion, with the width of the annular space being smaller than the wall thickness of the workpiece. Upon the initiation of the extrusion process, the tubular workpiece advances relatively freely to the annular space but upon initially engaging the die surface, or being advanced into the annular space of reduced width, initial extrusion resistance is met upon the annular space being initially closed or plugged by the advancing end of the workpiece before the tubular workpiece is first advanced through the annular space and actual extrusion commenced. This initial resistance or "plugging" causes the extrusion pressure to increase virtually instantaneously from zero to some peak, which peak has been found to exceed the running or continuous extrusion pressure by 25%–100% or even infinitely upon an initial "plugging" or "jam" condition. This initial resistance, or "plugging" or "jam," occurs so suddenly, virtually instantaneously, that lubrication provided on the I.D. and O.D. of the tubular workpiece does not have an opportunity to stabilize or function and the tip of the tubular workpiece experiences cold work hardening producing redundant work which increases the difficulty of extruding the workpiece tip. Further, the increase in the temperature in the tubular workpiece flowing through the annular space or zone of deformation during actual extrusion with its attendant enhancement of the extrusion process does not have an opportunity to occur and hence the initiation of the extrusion process is further retarded. Accordingly, it has been found that this initial extrusion condition causes extrusion machine overloading, excessive design requirements for the machine with its attendant excessive cost, occasional machine broken parts, and poor quality product at the beginning of the extrusion process with its attendant waste and undesirable cost.

Various solutions to this extrusion start-up condition are known to the prior art some of which, given their specific intended purpose, have worked reasonably satisfactorily. For example, such prior art solutions are disclosed in U.S. Pat. No. 3,756,061 issued Sept. 4, 1973, U.S. Pat. No. 3,767,368 issued Oct. 23, 1973, U.S. Pat. No. 3,766,769 issued Oct. 23, 1973 and U.S. Pat. No. 3,924,429 issued Dec. 9, 1973 (all such patents issued in the name of Francis J. Fuchs, Jr., inventor). However, it has been found that there still exists a need in the extrusion art for improved methods and apparatus for initiating tubular extrusion particularly where tubular product of reduced diameter and reduced wall thickness is produced from a tubular workpiece of larger diameter and larger wall thickness.

SUMMARY OF THE INVENTION

The present invention provides the above-noted desired improved methods and apparatus initiating extrusion of elongated hollow product, and more particularly cylindrical tubular product, by providing methods and apparatus for increasing the space between the end of a mandrel and an opposed extrusion die during extrusion start-up and thereafter gradually decreasing the space to the desired width for extrusion of the product to enhance extrusion initiation.

DESCRIPTION OF THE DRAWINGS

FIG. 1 is a cross-sectional illustration of a tubular workpiece of larger diameter and larger wall thickness extruded into a tubular product of smaller diameter and smaller or reduced wall thickness;

FIG. 2 is a diagrammatic cross-sectional illustration of the problem encountered upon the end of a tubular workpiece to be extruded into tubular product of smaller diameter and reduced wall thickness first encountering the annular space through which the workpiece is extruded into the product;

FIG. 5 is a graph illustrating the advantages of the methods and apparatus of the present invention with regard to the elimination or reduction of extrusion pressure piece during initiation of extrusion of tubular product.

DESCRIPTION OF THE PREFERRED EMBODIMENT

Figure 3:
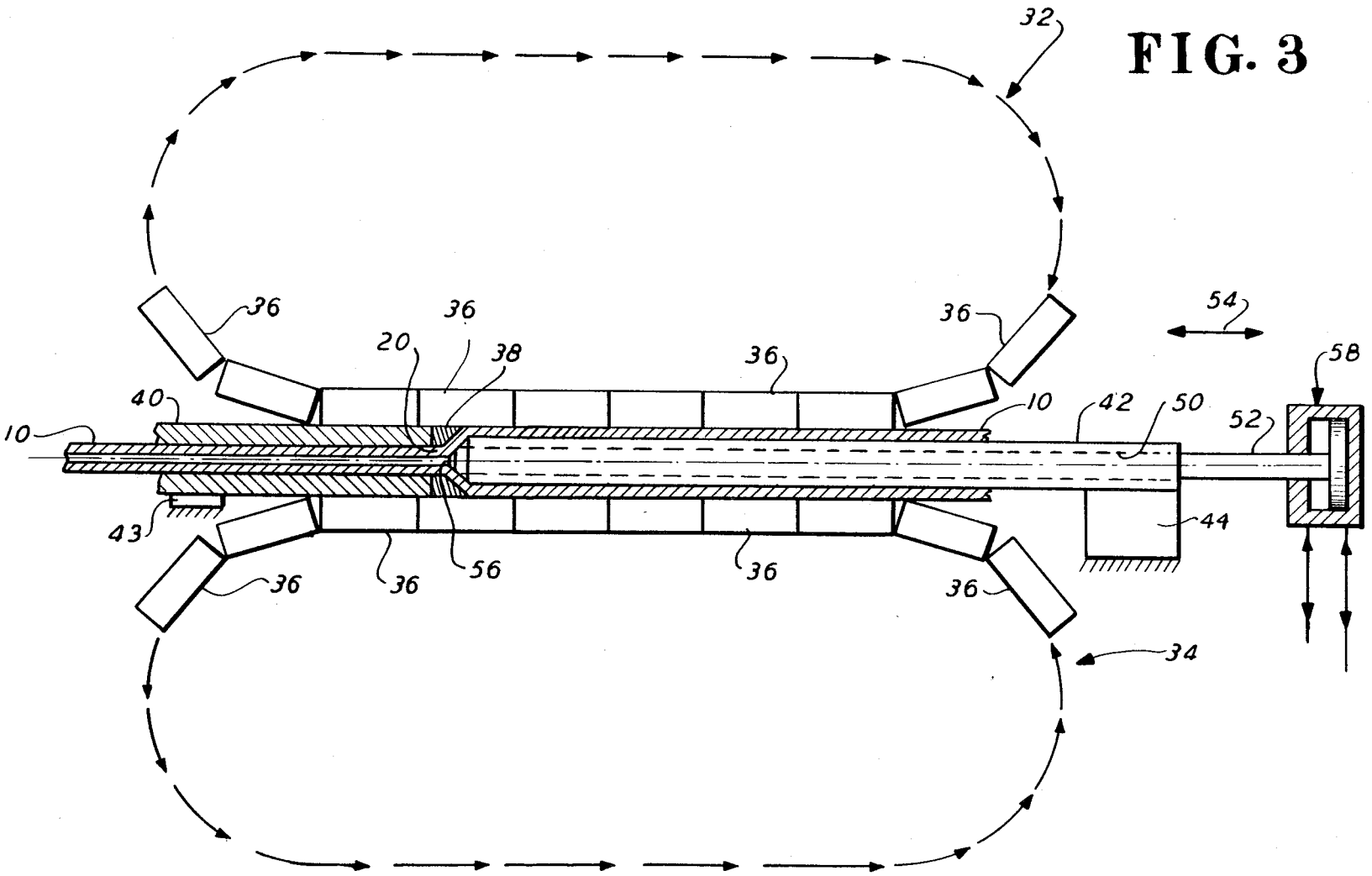
FIGS. 3 and 4 are diagrammatic illustrations of methods and apparatus embodied in continuous tubular extrusion apparatus with the figures illustrating, respectively, different conditions of operation in accordance with the teachings of the present invention set forth below.

The methods and apparatus of the present invention will be described in the context of apparatus for the continuous extrusion of a tubular workpiece of larger diameter and larger wall thickness into a tubular product of reduced diameter and reduced wall thickness; however, it will be understood that the methods and apparatus of the present invention are not restricted to a continuous extrusion of tubular product but are equally applicable to the extrusion of discrete tubular billets into tubular product of reduced diameter and reduced wall thickness.

Referring now to FIG. 1, there is shown a tubular workpiece 10 extruded into a tubular product 12 wherein, as may be noted, the diameter (O.D. and I.D.) and wall thickness of the tubular product 12 are reduced from the diameter and wall thickness of the tubular workpiece 10.

As noted above, and as illustrated diagrammatically in FIG. 2, the tubular workpiece 10 is advanced, for example, over a mandrel 14 into engagement with an annular extrusion die 16, supported by an annular die stem 18, and through the annular space between the end of the mandrel 14 and the extrusion die 16 which annular space is indicated at 20 in FIG. 2. It will be understood, and as noted from FIG. 2, that the width, transverse width, of the annular space 20 is smaller than the wall thickness of the workpiece 10. Accordingly, upon extrusion start-up and the initial advancement of the front end of the tubular workpiece 10 into the annular space 20, initial resistance is encountered due to the fact that the width, transverse width, of the annular space 20 is smaller than the wall thickness of the workpiece 10. The workpiece 10, upon encountering the restricted annular space 20 tends to "plug" or "jam" thereby halting the extrusion process at least initially. This "plug" or "jam" causes the extrusion pressure to peak as illustrated at point 24 in the solid line graph of FIG. 5 which peak extrusion pressure, as noted above, gives rise to unwanted and highly undesirable extrusion conditions and problems.

Figure 4:
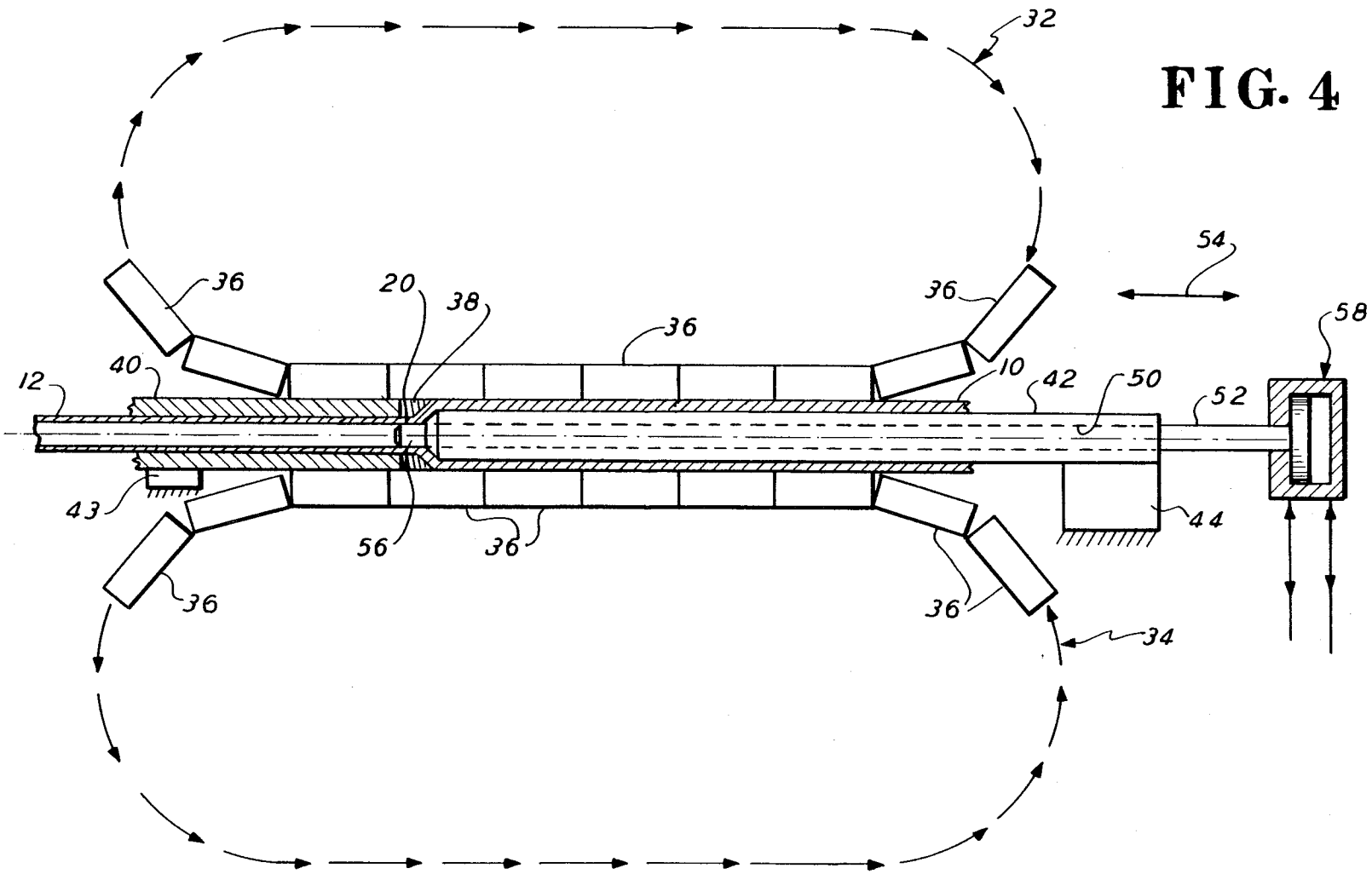

Referring now to FIGS. 3 and 4, it will be understood that the continuous extrusion apparatus illustrated therein by elliptical loops of arrows 32 and 34 and by groups or trains of gripping elements 36 may be, for example, the continuous extrusion apparatus disclosed in U.S. Pat. No. Re. 28,795 issued May 4, 1976 in the name of Francis J. Fuchs, Jr. as inventor; however, it will be expressly understood by those skilled in the art that the present invention is not limited to use with any such specific continuous extrusion apparatus and may be used advantageously with other continuous extrusion apparatus or with discrete tubular billet extrusion apparatus. The extrusion apparatus may include an annular extrusion die 38 suitably secured to and supported by a suitable die stem 40 (in the manner known to those skilled in the art) and a cylindrical mandrel 42. In the embodiment illustrated in FIGS. 3 and 4, it will be understood that the die 38 and die stem 40, and mandrel 42, are mounted stationarily by suitable means known to those skilled in the art and indicated, respectively, by mounting means 43 and 44; and, it will be further understood, and as may be understood in greater detail from reference to the above-noted U.S. Patent, that the trains or groups of gripping elements 36 are moved continuously around endless paths, indicated by elliptical loops of arrows 32 and 34 and in the direction of the arrows, to continuously apply motive force along the outer surface of the tubular workpiece 10 to continuously advance the workpiece 10 along the mandrel 42, against the extrusion die 38 and through the annular space 20 which annular space 20 is better understood by reference to FIG. 2 but is also indicated in FIGS. 3 and 4.

Now, in accordance with the teachings of the methods and apparatus of the present invention, it will be understood that the mandrel 42 is provided with a centrally formed, cylindrical axial bore 50 in which a cylindrical rod 52 is received for reciprocal forward and rearward relative movement with respect to the mandrel 42, as indicated by the double headed arrow 54 in FIGS. 3 and 4. The front end 56 of the rod 52 provides a pilot or pilot rod for being retracted from and extended into the annular space 20 as shown in FIGS. 3 and 4, respectively. To provide the rod 52 with such reciprocal movement, the rear end of the rod is mounted as a double acting piston, indicated generally at 58 in FIGS. 3 and 4, for operation in the manner well known to those skilled in the art; the double acting piston 58 may be operated, for example, by a well known 4-way valve to alternately provide pressurized fluid at the end of the double acting piston to advance it leftwardly as shown in FIGS. 3 and 4 and to provide pressurized fluid to the front of the double acting piston to advance it rightwardly as viewed in the FIGS.

For extrusion start-up, in accordance with the present invention, and referring to FIG. 3, the workpiece 10 is advanced over the mandrel 42, as described above, and the double acting piston 58, as illustrated in FIG. 3, is operated to move the rod 52 rightwardly as viewed in FIG. 3 thereby retracting the front end of the rod 56 or pilot from the annular space 20 to increase the width, transverse width, of the annular space 20 to be substantially equal to the wall thickness of the workpiece 10 whereby the workpiece 10 will be advanced freely between the end of the mandrel 42 and the extrusion die 38 and through the annular space 20 thereby avoiding the "plug" or "jam" and the unwanted and undesired pressure peak 24 indicated by the solid line graph in FIG. 5. Thereafter, the double acting piston is operated, as illustrated in FIG. 4, to gradually move the rod 52 leftwardly to extend the front end 56 of the rod or pilot into the annular space 20 a predetermined distance until the width, transverse width, of the annular space 20 is equal to the desired reduced wall thickness of the tubular product 12, whereafter the pilot remains in the position shown in FIG. 4 for continuous extrusion of the tubular product 12. It will be noted from reference to the dashed outline graph in FIG. 5 that upon the pilot being extended gradually into the annular space 20 a much smaller start-up extrusion pressure peak is experienced, smaller as compared to the solid line peak pressure 24, which reduced peak pressure overcomes the above-noted prior art problems associated with the higher peak pressure such as indicated at point 24 in FIG. 5.

Referring specifically to FIG. 5, to the solid line graph of the extrusion pressure without the retractable pilot of the present invention and the dashed line graph of the extrusion pressure used in the retractable pilot of the present invention, it will be noted that the start-up extrusion pressure using the retractable pilot of the present invention produces a much lower start-up peak extrusion pressure and thereby overcomes the above-noted prior art problems and advances the extrusion art.

Figure 6:
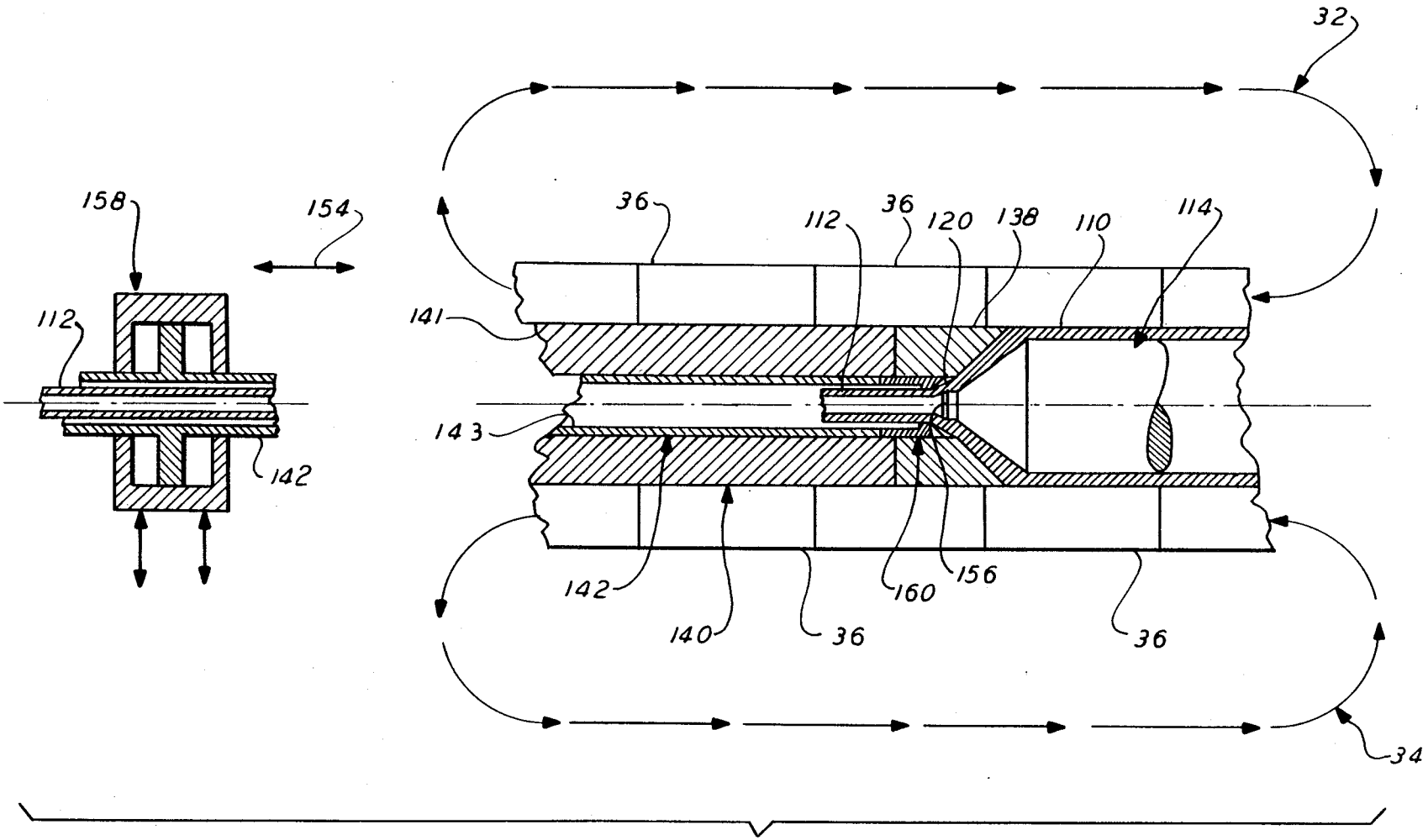
FIGS. 6, 7 and 8 are FIGS. similar to FIGS. 3 and 4 but disclose alternate embodiments of the improved methods and apparatus of the present invention for initiating the extrusion of a tubular product wherein an inner annular die is reciprocated relative to an outer annular die.
Figure 7:
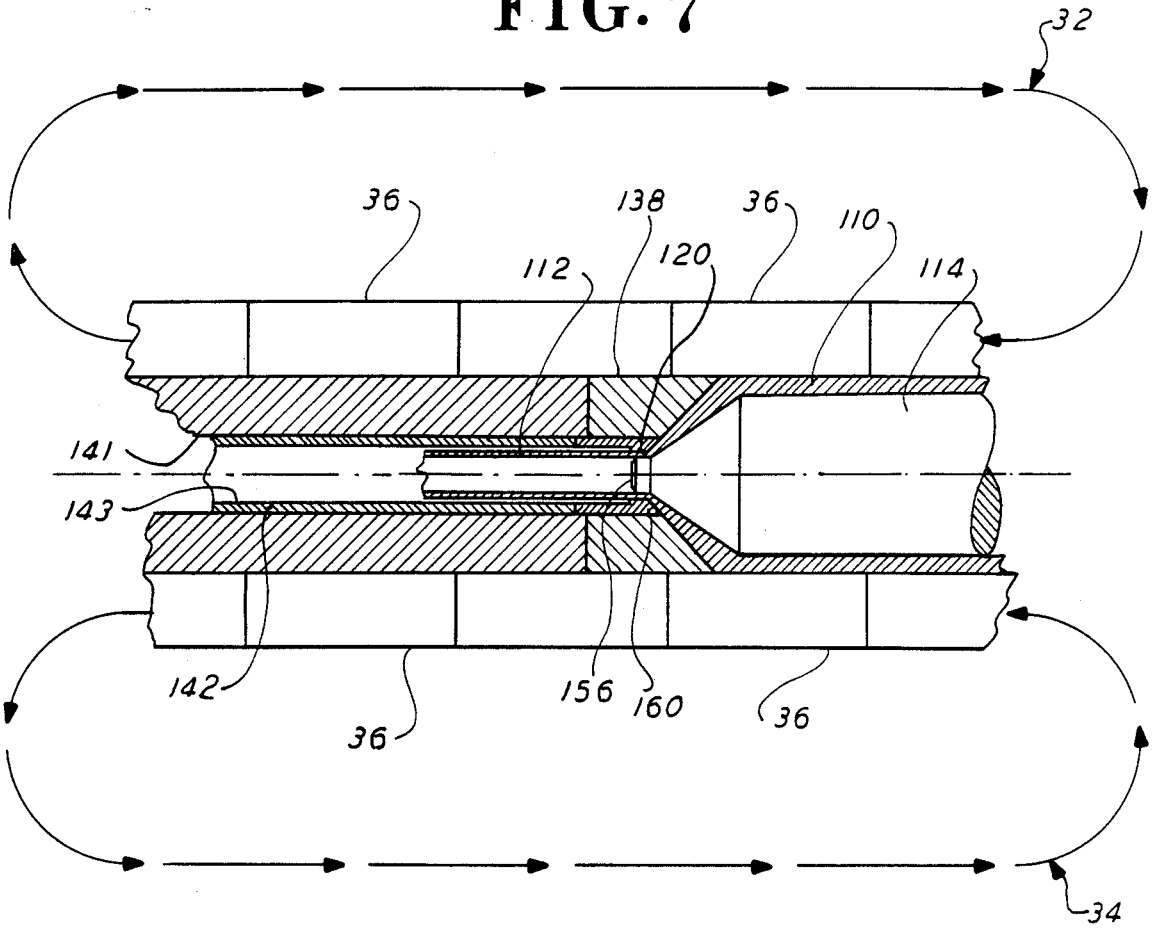
Figure 8:
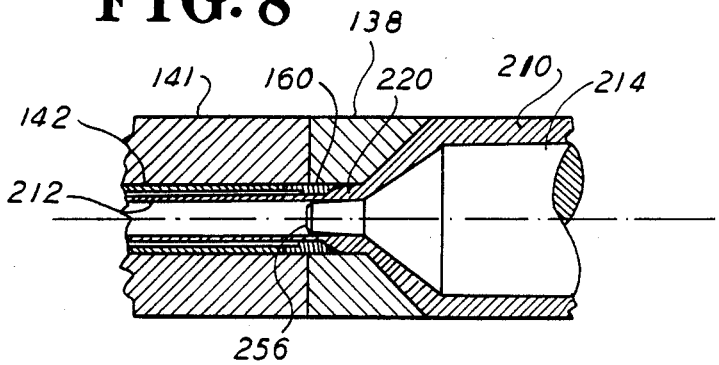

Referring now to FIGS. 6, 7 and 8, alternate embodiments of the improved methods and apparatus of the present invention for initiating the extrusion of tubular product 112 of decreased diameter and decreased wall thickness from a tubular workpiece 110 of larger diameter and larger wall thickness are illustrated. In these alternate embodiments, identical reference numerals are used to refer to identical or equivalent structure illustrated in the earlier embodiment.

It will be understood, generally, that the basic difference between these alternate embodiments and the earlier embodiment is that instead of alternately advancing and retracting the front end pilot or pilot rod 56 to alternately increase or decrease the die gap or annular space 20 of the earlier embodiment (FIGS. 3 and 4) to enhance extrusion initiation, an inner annular die 160 (FIGS. 6 and 7), mounted for reciprocating sliding movement within a stationarily mounted outer annular die 138, is alternately retracted from and advanced into the die gap or transverse annular space 120 by being alternately moved as indicated by the double headed arrow 154 by suitable operation of the double acting piston 158; the outer annular die 138 and inner annular die 160 are suitably supported by annular die stems 141 and 142 with the outer die stem 141 being mounted stationarily and with the inner die stem 142 having its rear end mounted as the double acting piston 158, the mandrel 114 and pilot rod 156 are of unitary construction and mounted stationarily. Upon retraction of the inner annular die 160, as may be understood from FIG. 6, the groups or trains of gripping elements 36 of the continuous extrusion apparatus 32 may then easily advance the tubular workpiece 110 through the increased die gap or annular space 120 to initiate extrusion of the tubular product 142; such tubular product being advanced through the cylindrical passageway 143 provided centrally interiorly of the inner annular die stem 142. Thereafter, the double acting piston 158 (FIG. 6) is operated, as illustrated in FIG. 7, to gradually move the inner annular die stem 142 and the inner annular die 160 rightwardly into the die gap or annular space 120 a predetermined distance until the width, transverse width, of the annular space 120 is equal to the desired reduced wall thickness of the tubular product 112 whereafter the inner annular die 160 remains in the positions shown in FIG. 7 for continuous extrusion of the tubular product 112. It wil be understood that the inner annular extrusion die and outer annular extrusion die may be referred to collectively as a composite annular extrusion die. It will further be understood that such operation of the reciprocably mounted inner annular die 160, as with the earlier described reciprocably mounted pilot or pilot rod 56, also requires a much smaller start-up extrusion pressure peak (FIG. 5) which reduced peak pressure overcomes the above-noted prior art problems associated with the higher peak pressure indicated at point 24 in FIG. 5.

It will be still further understood in accordance with the teachings of the present invention that the truncated conical inner surface of the annular extrusion die 38 may be either parallel to the truncated conical outer surface of the forward end of the cylindrical mandrel 42 as shown in FIGS. 3 and 4 or, as shown in the embodiments of FIGS. 7 and 8, the truncated conical inner surface of the annular extrusion die 38 may be provided with a larger included angle than the included angle of the truncated conical outer surface of the forward end of the mandrel 42 and, similarly, the truncated conical inner surface of the composite annular extrusion die (outer annular die 138 and inner annular die 160) of FIGS. 7 and 8 may be provided with an included angle the same as the included angle of the truncated conical outer surface of the forward end of the mandrel 42 or may be provided with an included angle, as shown in FIGS. 7 and 8, larger than the included angle of the truncated conical outer surface of the forward end of the mandrel. It has been found that, depending upon the material of the tubular workpiece being extruded, it may be advantageous to provide a die gap or annular space 20–120 which decreases inwardly to enhance extrusion and/or extrusion initiation. Further, it will be understood that the front end pilot or pilot rod 56 may be cyclindrical and parallel to the inner surface of the annular extrusion die 38 and composite annular extrusion dies 138 and 160 to provide a variable die gap 20 which is of uniform width or, alternately, as indicated in FIG. 8, the outer surface of the mandrel pilot rod 256, as shown, may be provided as a truncated conical surface whereby the variable die gap 220 decreases inwardly. Again, depending upon the material of the tubular workpiece being extruded, it has been found to be preferable to provide a variable die gap which increases inwardly to enhance extrusion and/or extrusion initiation.

It will be understood by those skilled in the art that while the preferred embodiments of the present invention are taught in the context of the extrusion of cylindrical tubular product of circular cross-sectional configuration, the present invention is not so limited and may be used with equal advantage in the extrusion of hollow product of various cross-sectional configurations, such as for example rectangular, triangular, and still more particularly, it will be understood that the present invention may be used with equal advantage in the extrusion of hollow product wherein the interior of the hollow product is of one cross-sectional configuration, for example circular, while the exterior of the hollow product is of a different cross-sectional configuration, for example rectangular or triangular. Accordingly, it will be understood that many modifications and variations may be made in the present invention without departing from the spirit and the scope thereof.

Further, it will be understood that the above-described apparatus for initiating extrusion also provides apparatus providing an extrusion die of variable opening or a variable die gap for extruding an elongated member such as tubing.

What is claimed is:

1. Apparatus for extruding an elongated member such as tubing and for enhancing extrusion initiation, said tubing having an O.D., an I.D. and a wall thickness, comprising:

an annular extrusion die having a die surface defined by a forward truncated conical inner surface having a first predetermined included angle and a cylindrical rearward inner surface of constant diameter substantially equal to the tubing O.D.;

a mandrel having a forward portion defined by a truncated conical outer surface having a second predetermined included angle smaller than said first predetermined angle, said mandrel truncated conical outer surface positioned opposite said forward truncated conical inner surface of said annular die to provide a die gap therebetween which decreases inwardly to enhance extrusion initiation, said mandrel provided with a centrally formed axial bore extending therethrough;

a pilot rod residing in said axial bore for relative reciprocal sliding movement with respect to the mandrel, said pilot rod provided with a cylindrical outer surface of constant diameter substantially equal to said tubing I.D. and smaller than the constant diameter of the rearward surface of said annular extrusion die by an amount substantially equal to said tubing wall thickness;

means for retracting the pilot rod from said extrusion die during extrusion start-up and for extending the pilot rod a predetermined distance into the rearward portion of said annular extrusion die during extrusion to extrude said tubing with said wall thickness.

2. Apparatus for providing a variable die gap for extruding an elongated member such as tubing, comprising:

a mandrel having a forward portion defined by a truncated conical outer surface extending into the outer surface of a mandrel pilot rod, said conical outer surface having a first predetermined included angle;

a composite annular extrusion die including an outer annular extrusion die having a passageway extending therethrough and an inner annular extrusion die mounted reciprocably in said passageway, said inner and outer annular extrusion dies each having a die surface defined by a truncated conical inner surface having a second predetermined included angle, said composite annular extrusion die positioned opposite and spaced from said forward portion of said mandrel and said variable die gap defined by the generally annular distance between the inner surfaces of said outer and inner annular extrusion dies and said outer surfaces of said mandrel and mandrel pilot rod;

means for retracting said inner annular extrusion die a predetermined distance into said passageway to increase the size of said variable die gap and for extending said extrusion die a predetermined distance into said passageway to align the inner surfaces of said inner and outer annular extrusion dies.

3. Apparatus according to claim 2 wherein said first predetermined included angle and said second predetermined included angle are equal whereby upon said inner surface of said inner annular extrusion dies being aligned the width of said variable die gap is uniform.

4. Apparatus according to claim 2 wherein said second predetermined included angle is larger than said first predetermined included angle whereby upon said inner surface of said inner and outer annular extrusion dies being aligned the width of said variable die gap decreases inwardly.

5. Apparatus according to claim 2 wherein the outer surface of said mandrel pilot rod is cylindrical and wherein said inner annular extrusion die has a cylindrical passageway extending therethrough whereby upon said inner surfaces of said inner and annular extrusion dies being aligned said mandrel pilot rod extends into said cylindrical passageway to provide a portion of said variable die gap which portion is of uniform width.

6. Apparatus according to claim 2 wherein the outer surface of said mandrel pilot rod is a truncated conical surface and wherein said inner annular extrusion die has a cylindrical passageway extending therethrough whereby upon said inner surfaces of said inner and annular extrusion dies being aligned said mandrel pilot rod extends into said cylindrical passageway to provide a portion of said variable die gap which portion increases inwardly.

* * * * *